US006647943B2

(12) United States Patent
Leimer et al.

(10) Patent No.: US 6,647,943 B2
(45) Date of Patent: Nov. 18, 2003

(54) VALVE STEM SEAL ASSEMBLY WITH LOCATOR SYSTEM

(75) Inventors: Mark A. Leimer, Fort Wayne, IN (US); Mark A. Stamback, Avilla, IN (US); Robert W. Lehmann, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 42 days.

(21) Appl. No.: 09/919,416

(22) Filed: Jul. 31, 2001

(65) Prior Publication Data

US 2003/0024497 A1 Feb. 6, 2003

(51) Int. Cl.[7] ..... F01L 7/00
(52) U.S. Cl. ..... 123/190.17; 123/188.6
(58) Field of Search ..... 123/190.17, 188.6, 123/188.9

(56) References Cited

U.S. PATENT DOCUMENTS 3,333,578 A 8/1967 Muller
3,589,346 A * 6/1971 Warren et al. ..... 123/90.41
4,947,811 A 8/1990 Binford
5,174,256 A 12/1992 Binford
5,237,971 A 8/1993 Worsley
5,775,284 A 7/1998 Kirchner et al.
6,230,679 B1 * 5/2001 Hegernier et al. ..... 123/190.17
6,269,787 B1 * 8/2001 McArthy ..... 123/188.6

* cited by examiner

*Primary Examiner*—Tony M. Argenbright
*Assistant Examiner*—Katrina B. Harris
(74) *Attorney, Agent, or Firm*—Rader, Fishman & Grauer, PLLC

(57) ABSTRACT

A valve stem seal component overcomes potential orientation misplacement, particularly in cases where no valve stem seal is to be used on an adjacent valve. The component includes an integral locator feature for assuring proper installation atop a valve guide of an internal combustion engine. A plurality of such seal components are employed per engine, each component designed for insertion over at least the intake valve guide of each cylinder. Each component includes a valve stem seal module adapted to be installed over the intake valve guide. A locator is attached to the module via a radial connection portion that extends between the module and locator. The radial connection portion includes an arcuate edge that fits in only one orientation against a curvilinear edge of a boss on the cylinder head. In one described embodiment, the locator is a circular ring adapted to be installed over an exhaust guide.

10 Claims, 3 Drawing Sheets

VALVE STEM SEAL ASSEMBLY WITH LOCATOR SYSTEM

BACKGROUND OF THE INVENTION

1. Field of Invention

The present invention relates to valve stem seal assemblies for use in internal combustion engines, and more particularly to the design and construction of valve stem seal components for facilitating assembly and installation thereof onto valve guides of said engines.

2. Description of the Prior Art

Intake and exhaust valves are employed in cylinder heads of internal combustion engines. Such valves, supported for reciprocal motion within valve guides, include integral elongated stems extending from within the engine cylinder heads, the ends of the stems typically interacting with rotating overhead cams for cyclic opening and closing of the valves against the force of valve return springs during the combustion cycle. In order to permit unobstructed reciprocal movement of the stem in the guide, some mechanical clearance must obviously exist between the valve guide and the moving stem. In fact, a plurality of such valve stems move reciprocally in valve guides, to and from the cylinder head, each within its individual guide. So-called valve stem seal assemblies are used to seal against leakage of oil through a mechanical clearance path between each annular engine valve guide and its associated valve stem.

As is well known, the intake port of a combustion chamber is opened and closed by the reciprocating motion of at least one intake valve, which in turn is driven by the rotary motion of a cam, the latter being affixed to and rotatable with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of similar construction and both include stems integrally affixed to the valves.

In some engines, a unitary elastomeric valve stem seal component is fitted over or atop each valve guide, wherein the seal component is frictionally mounted directly to the guide. In other cases the seal is encased within or otherwise secured to a rigid, typically metal, seal retainer to form an assembly to assure proper securement of the seal to the guide. Those skilled in the art will appreciate that pluralities of such elastomeric valve stem seal components are employed in typical engines.

In the case of small engines, for example those used in lawnmowers, V-style engines have become popular with one cylinder in each V-bank. In some cases, only one valve stem seal component is employed per cylinder, the one valve stem seal component being located at the intake valve of the cylinder. In such cases, the exhaust valve is operated without a valve stem seal component. During assembly, since the guides of intake and exhaust valves look alike, an installer can become confused, inserting the seal component on the exhaust valve instead of on the intake valve.

SUMMARY OF THE INVENTION

The improved valve stem seal component of the present invention overcomes the occasional and or potential confusion issues associated with installation of valve stem seals on an intake valve, particularly in cases where no valve stem seal is to be used on the exhaust valve. The component also streamlines valve stem seal component installation, and thus promotes a more cost-effective assembly line process.

The invention provides an integral position locator on a valve stem seal component having a seal module adapted for installation directly atop of a valve guide of an internal combustion engine. A plurality of such seal components are contemplated for use in an engine, each component designed for insertion over a seal module on at least the intake valve guide of each cylinder.

In the described embodiment, the valve stem seal component includes the valve stem seal module adapted to be directly installed over an intake valve guide. The locator is attached to the module via an integral radial connection portion that extends between the module and the locator. In the described embodiment, the locator is a circular ring adapted to be installed over the exhaust guide.

Finally, the radial connection portion includes an arcuate edge adapted to fit only in one orientation against a curvilinear edge of a protruding boss on the cylinder head. In addition, both the radial connection portion and the protruding boss contain matching indicia to assure proper correspondence and hence placement by the installer during assembly of the valve stem seal component.

DETAILED DESCRIPTION OF ONE PREFERRED EMBODIMENT

Figure 1:
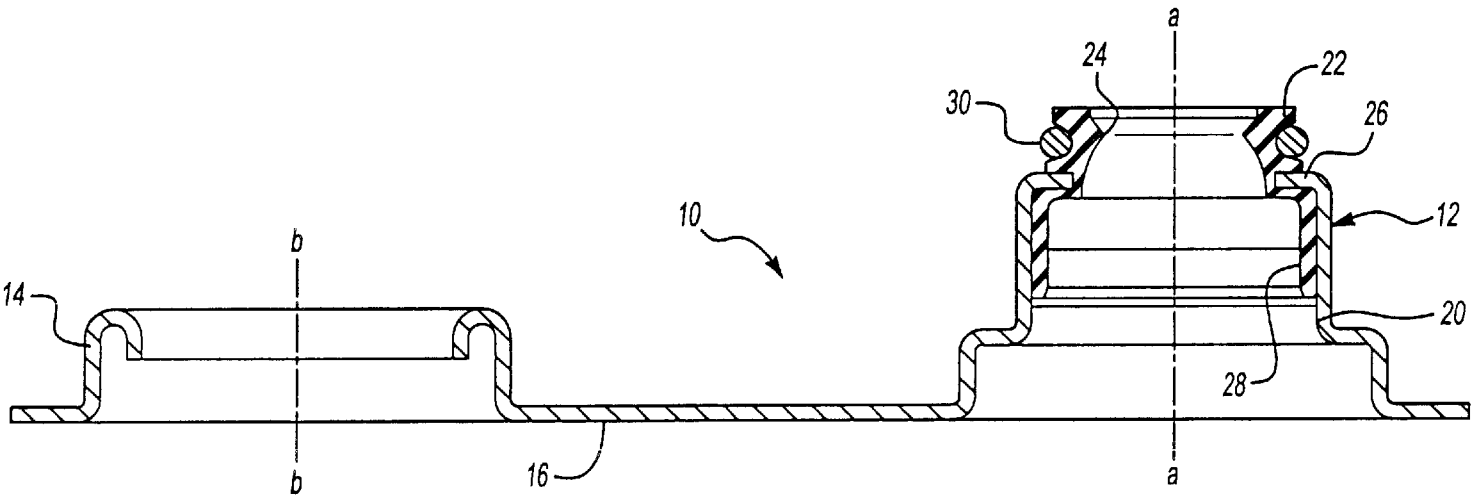
FIG. 1 is a cross-sectional view of one described embodiment of the valve stem seal component of the present invention, including a particular view of the valve stem seal module adapted to be installed over a valve guide of an internal combustion engine.
Figure 2:
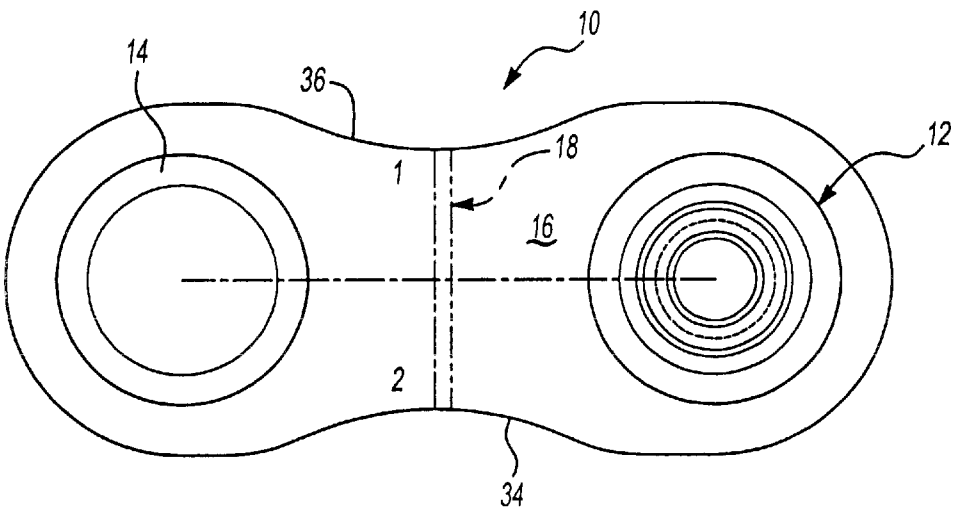
FIG. 2 is a plan view of the same preferred embodiment of the valve stem seal component.
Figure 5:
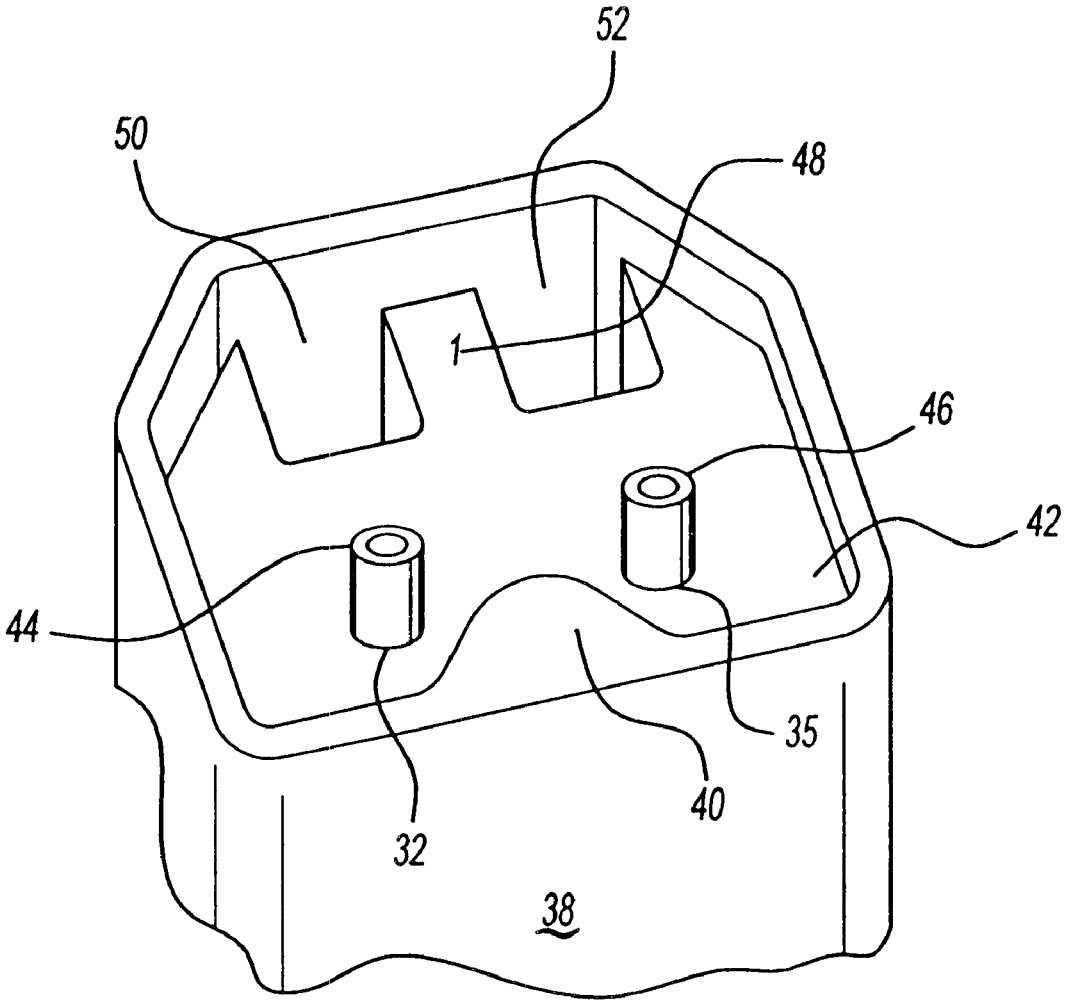
FIG. 5 is a perspective view of a cylinder head adapted for use with either of the described embodiments of the valve stem seal component of the present invention.

Referring initially to FIGS. 1 and 2, a first embodiment of a valve stem seal component 10 is shown. Referring also to FIG. 5, the component 10 includes a valve stem seal module 12 adapted to be installed over a valve guide 46. The module 12 incorporates an axis a—a and is defined in part by a base formed of a metallic valve stem seal retainer 20, and a resilient elastomeric seal jacket 22 that includes an interior circumferentially extending sealing lip 24. The lip 24 is adapted to sealingly engage an elongate valve stem (not shown).

Those skilled in the art will appreciate that each valve stem extends upwardly from a valve (not shown), and is adapted to close against a valve seat (not shown) within the top of a combustion chamber/cylinder head 38. Each stem is supported for reciprocal movement within an annular valve guide 44, 46. The guides 44, 46 (representing exhaust and intake, respectively, as displayed) are fixedly secured in, and extend longitudinally (or upwardly, as shown) through apertures 32, 35 of a cylinder head deck 42. An exhaust port 50 and an air intake port 52 are situated opposite the valve guides 44, 46 in the engine cylinder head deck 42.

For securement of the module 12 to a valve guide 44, 46, an interior elastomer body surface 28 of the seal module 12 is frictionally supported directly to the exterior surface of the valve guide 44, 46. For sealing engagement of each reciprocally moving valve stem, the circumferentially extending sealing lip 24 is adapted to engage the exterior circumferential surface of the stem for limiting and or otherwise controlling movement of crankcase oil along a mechanical clearance path (not shown) between the stem and guide for undesirable escape of oil into the combustion chamber, as will be appreciated by those skilled in the art. The retainer 20 of the module 12 is adapted to secure the exterior annular body of the elastomeric seal jacket 22 via a circumferentially disposed, radially inwardly extending portion 26. Finally, to enhance sealing effectiveness, a garter spring 30 encircles the exterior upper body portion of the jacket 22, radially outwardly of the sealing lip 24, to impart a radial compression force against the lip 24, and ultimately against a reciprocally moving valve stem encircled by the lip 24.

Referring now specifically to FIGS. 1 and 5, it will be appreciated that the construction of the valve stem seal component 10 of this invention includes a circular locator 14 having an axis b—b, and adapted to fit over one of the guides 44, 46. This particular embodiment of the component 10 provides a means by which an exhaust valve (not shown) of the cylinder head 38 may operated without a valve stem seal, as is desirable in the operation of some small engines. Thus, only one valve stem seal module 12 is incorporated in the component 10 of FIG. 1. The singular seal module 12 is adapted to be inserted over the intake guide 46 of the cylinder head 38; the locator 14 is adapted to be inserted over the exhaust guide 44.

The locator 14 provides for accurate mounting of the module 12, and is directly affixed to the module 12 via a radial connection portion 16. The connection portion 16 includes arcuate edges 34 and 36 adapted for engaging a cylinder head locator boss 40 (FIG. 5). The locator boss 40 is cast into the top of the engine cylinder head 38 and forms a portion of the cylinder head deck 42. When the connection portion edge 34 is aligned in its proper orientation, the edge 34 fits symmetrically against the locator boss 40. Each edge 34, 36 is formed asymmetrically, and the connection portion 16 includes a slight extended section 18 (e.g. approximately one millimeter) to assure that proper fit is achieved only upon proper orientation of the component 10.

Referring now specifically to FIG. 2, it will be seen that special indicia can be either stenciled or stamped into the metal component body for assuring proper orientation of the component 10 over the valve guides 44, 46 and against the cylinder head 38. For this purpose, numerals 1 and 2 are shown stenciled on the first described embodiment of the component 10. Correspondingly identical indicia are shown embossed or stenciled on the cylinder head deck 42 (FIG. 5) to assure correspondence and to confirm proper orientation of the component 10 atop the cylinder head 38.

Figure 3:
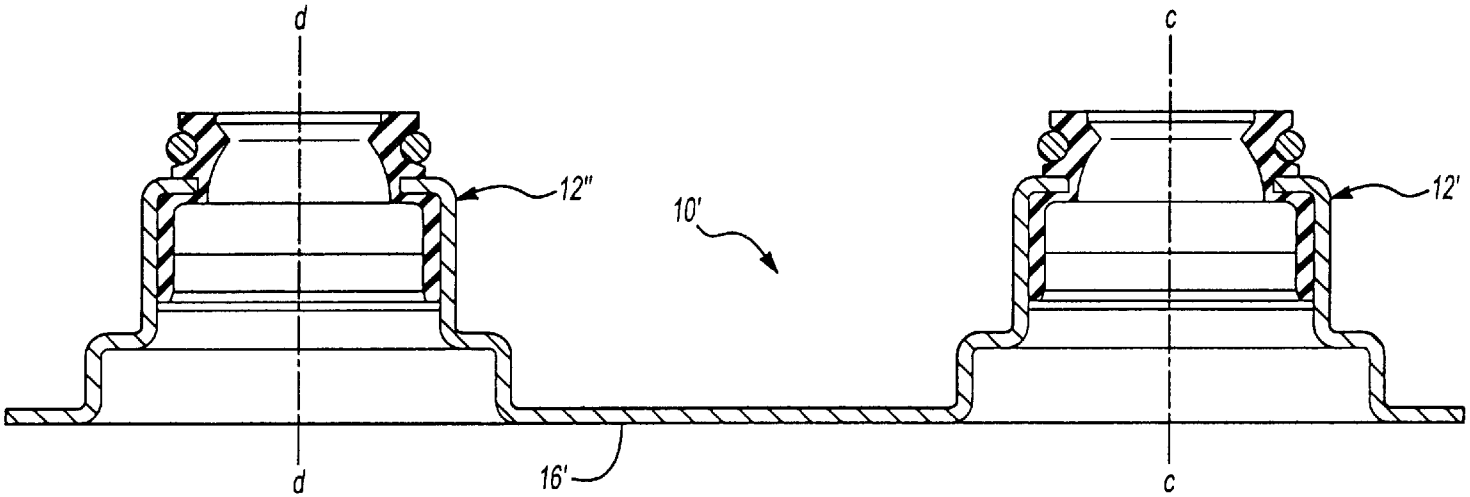
FIG. 3 is a cross-sectional view of an alternate embodiment of a valve stem seal component of the present invention.
Figure 4:
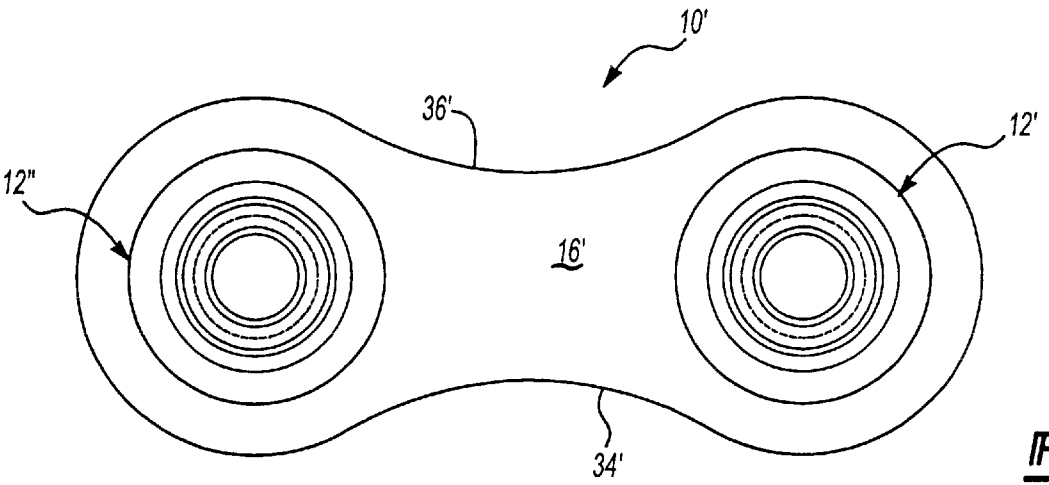
FIG. 4 is a plan view of the alternate embodiment of the valve stem seal component of FIG. 3.

Referring now to FIGS. 3 and 4, an alternate embodiment of the component 10' is shown that incorporates dual modules 12' and 12" for situations wherein both intake and exhaust valve stem seals are to be employed on the engine cylinder head 38. The component 10' contains essentially all of the features described in the prior described first embodiment of FIGS. 1 and 2, except for the inclusion of a second module 12" in the place of the locator 14. Thus, in the component 10', the arcuate edges 34' and 36' are analogous to the arcuate edges 34 and 36 of the component 10, and operate in the same manner to assure proper orientation.

It is to be understood that the above description is intended to be illustrative, and not limiting. Many embodiments will be apparent to those of skill in the art upon reading the above description. The scope of the invention should be determined, however, not with reference to the above description, but with reference to the appended claims and the full scope of equivalents to which the claims are entitled by law.

What is claimed is:

1. A valve stem seal component including at least one valve stem seal module adapted for installation atop a valve guide of an internal combustion engine, said module having a longitudinally extending axis; said component further including a component position locator integrally affixed to said module; said component further comprising a radially extending connection portion adapted to connect said module with said component position locator, said connection portion extending between said module and said locator, and connecting said locator to said module, and wherein said connection portion is adapted to engage a cylinder head boss of a cylinder head.

2. The valve stem seal component of claim 1 wherein said module is adapted to be installed on an intake valve guide.

3. The valve stem seal component of claim 1 wherein said locator comprises a circular ring adapted to be installed over an exhaust guide.

4. The valve stem seal component of claim 1 wherein said connection portion comprises an arcuate edge adapted to assure proper orientation of said component against said cylinder head boss.

5. The valve stem seal component of claim 4 wherein said cylinder head boss defines a curvilinear edge adapted to symmetrically engage the arcuate edge of said connection portion upon proper orientation of said component.

6. The valve stem seal component of claim 5 wherein said indicia is stenciled onto the connection portion of said component.

7. The valve stem seal component of claim 1 further comprising a set of indicia on said component to assure proper orientation of said component against said cylinder head boss.

8. The valve stem seal component of claim 7 wherein said arcuate edges of said connection portion are asymmetrical.

9. The valve stem seal component of claim 1 wherein said module comprises an annular valve stem seal body including an annular elastomeric jacket adapted to engage a reciprocating valve stem.

10. A valve stem seal component comprising a pair of valve stem seal modules, each defining a longitudinally extending axis, said axes being parallel to one another, said component further comprising a connection portion, wherein said connection portion surrounds said pair of valve stem seal modules and extends orthogonally between said axes and connecting said modules to each other.

* * * * *